US006619156B1

(12) United States Patent
Super et al.

(10) Patent No.: US 6,619,156 B1
(45) Date of Patent: Sep. 16, 2003

(54) VEHICLE PEDAL ATTACHMENT

(75) Inventors: Orion J. Super, Sunny Isles, FL (US); Mark W. Ello, Pembroke Pines, FL (US)

(73) Assignee: Quest Industries, Inc., Miami, FL (US)

( * ) Notice: Subject to any disclaimer, the term of this patent is extended or adjusted under 35 U.S.C. 154(b) by 0 days.

(21) Appl. No.: 09/992,707

(22) Filed: Nov. 17, 2001

(51) Int. Cl.[7] ..... G05G 1/16
(52) U.S. Cl. ..... 74/563
(58) Field of Search ..... 74/560, 561, 562, 74/562.5, 563, 564, 594.4

(56) References Cited

U.S. PATENT DOCUMENTS 3,857,585 A * 12/1974 Foster ..... 74/594.4
4,269,084 A * 5/1981 Okajima ..... 74/594.6
4,521,940 A * 6/1985 Oetiker ..... 24/282
4,638,685 A * 1/1987 Cigolini ..... 74/594.4
4,665,767 A * 5/1987 Lassche ..... 74/594.6
4,953,425 A * 9/1990 Barefoot ..... 74/594.4
4,958,419 A * 9/1990 Heckethorn et al. ..... 24/283
5,398,570 A 3/1995 Chae
5,913,948 A 6/1999 Lien

FOREIGN PATENT DOCUMENTS

WO WO 89/02625 * 3/1989 ..... G05G/1/14

* cited by examiner

*Primary Examiner*—David Fenstermacher
*Assistant Examiner*—Bradley J. Van Pelt
(74) *Attorney, Agent, or Firm*—Alvin S. Blum

(57) ABSTRACT

A skid resistant cover assembly includes a rigid top plate provided with skid resistant top surface. A support plate below the top plate is clamped to the pedal of a vehicle by a strap clamp that passes over the support plate and past both sides of the pedal. The strap clamp is drawn tightly together under the pedal by mechanisms well known in the art. The top plate is then secured to the support plate by screw fasteners.

7 Claims, 6 Drawing Sheets

VEHICLE PEDAL ATTACHMENT

This invention relates to a skid resistant covering plate for attachment to the pedal of a vehicle, and more particularly to an improved means for attachment of the plate to the pedal.

BACKGROUND OF THE INVENTION

Vehicle pedals are commonly furnished with small rubber snap-on covers. These are often too small for convenient operation, and the foot can easily slip off them in an emergency. They wear down unevenly, and become unsightly. The pedals are often in a cramped space with difficult access. The pedals come in a variety of shapes and sizes. It would be awkward to provide a different device for each size and shape, and not easily marketed.

Prior art skid resistant covers such as those described by Chae in U.S. Pat. No. 5,398,570 issued Mar. 21, 1995, and Lien in U.S. Pat. No. 5,913,948 issued Jun. 22, 1999 provide a desirable large solid, skid resistant cover, but the means for attachment to the pedal are cumbersome, and the structure is expensive to fabricate.

It would be useful to have a skid resistant cover assembly that would include an attachment means that would be easy to install on the pedal in the cramped space, and inexpensive to manufacture.

SUMMARY OF THE INVENTION

It is accordingly an object of the invention to provide a skid resistant cover with an attachment means that is easy to install, and inexpensive to manufacture. It is another object that the device be readily adapted to installation on the many different pedals without requiring special skills from the user. The device of the invention comprises a large, rigid plate with a skid resistant upper surface and holes for receiving fasteners therethrough. The plate is supported securely on the pedal by a lower support member into which the fasteners are attached. The support member fits atop the pedal, and it is attached to the pedal by a flexible strap that passes over the top of the member and beneath the pedal. The strap is drawn tightly by a simple screw mechanism well known in the art to pull the member down tightly on the pedal for a secure attachment. After the member is tightly fastened in place, the cover plate is then attached with the fasteners.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
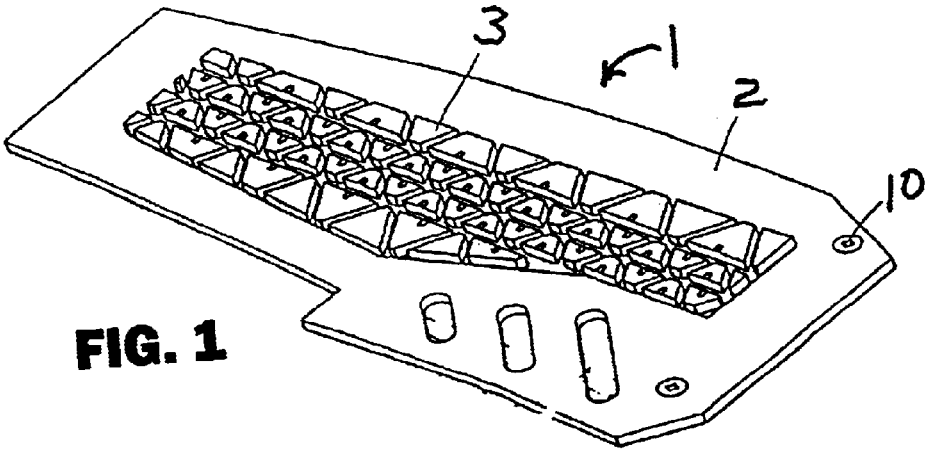
FIG. 1 is a perspective view of the top of the rigid plate of the invention.
Figure 2:
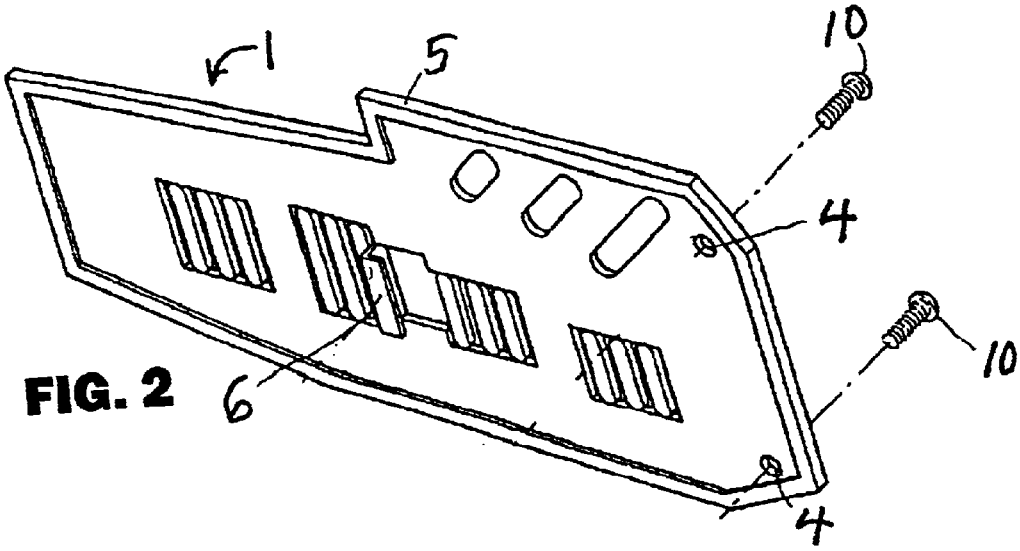
FIG. 2 is a perspective view of the underside of the rigid plate of the invention.
Figure 3:
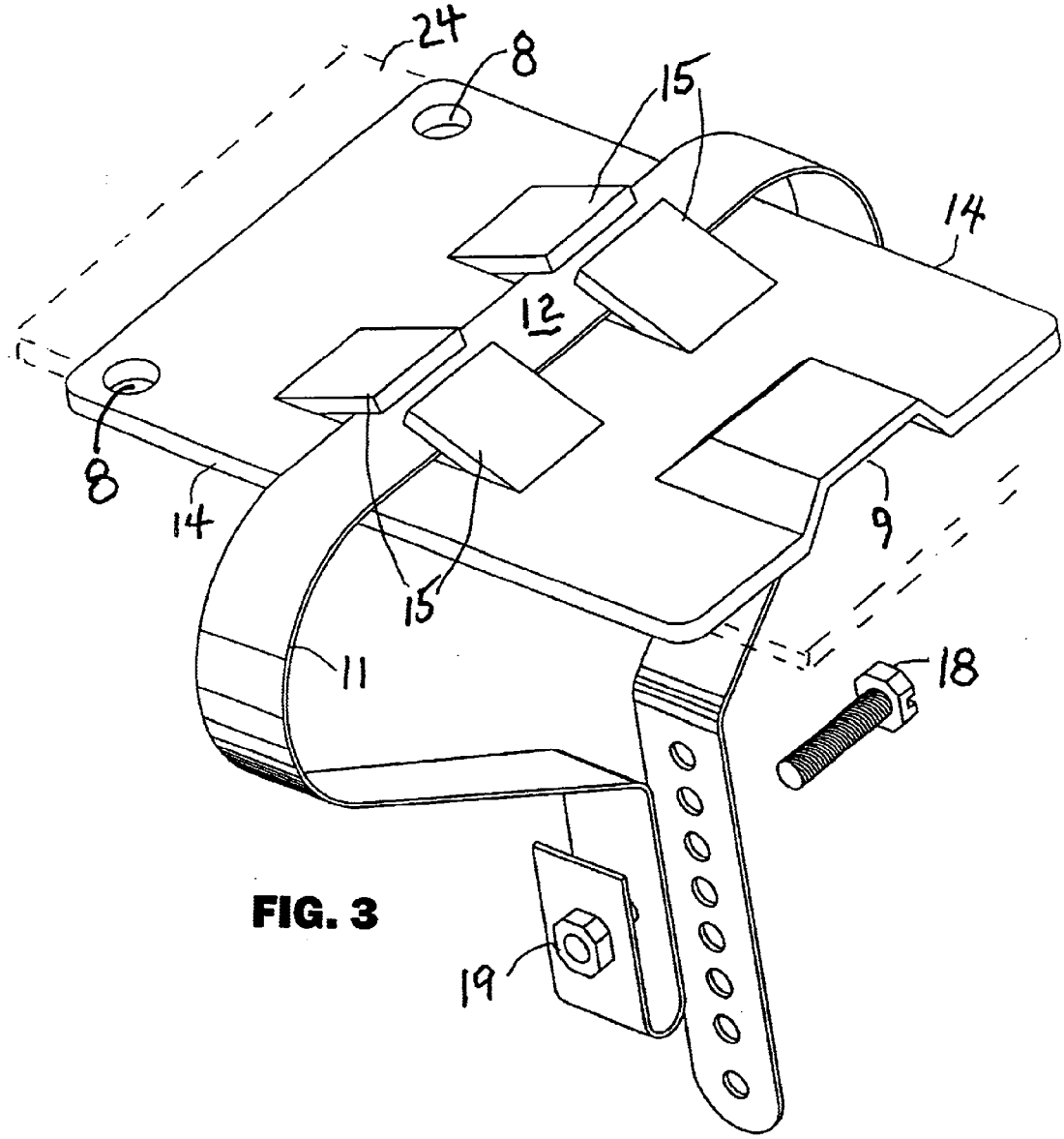
FIG. 3 is a perspective view of the support member and strap clamp of the invention.

Referring now first to FIGS. 1–3, the skid resistant pedal cover assembly of the invention comprises a rigid top plate 1 that has an upper surface 2 provided with skid resistant material such as a cemented-on rubber plate with a tread 3. The lower surface 5 is provided with a retaining hook 6. Through holes 4 in plate 1 are provided for threaded fasteners 10. A support member 7 is clamped onto the top of the vehicle pedal 24 by means of a flexible strap clamp 11 that has an intermediate portion 12 that is disposed over the top 13 of member 7, with the ends passing down the sides 14 of the member. The end are drawn tightly together under the bottom of the pedal by means well known in the art, such as the screw 18 and threaded receptacle 19 shown here to clamp the support member tightly to the pedal. The intermediate portion 12 of the strap is held in place on the member 7 by struck out flaps 15. The member 7 may be economically fabricated by a stamping process. After the support member is tightly clamped on the pedal, the retaining hook 6 on the rigid top plate 1 is fitted into the recess 9 on the support member, and fasteners 10 are fastened through holes 4 on plate 1 into corresponding threaded apertures 8 in member 7. This securely fastens the skid resistant plate on the pedal. The assembly is easy to apply with no special skills or tools. It is applicable to many different pedals without modification.

Figure 4:
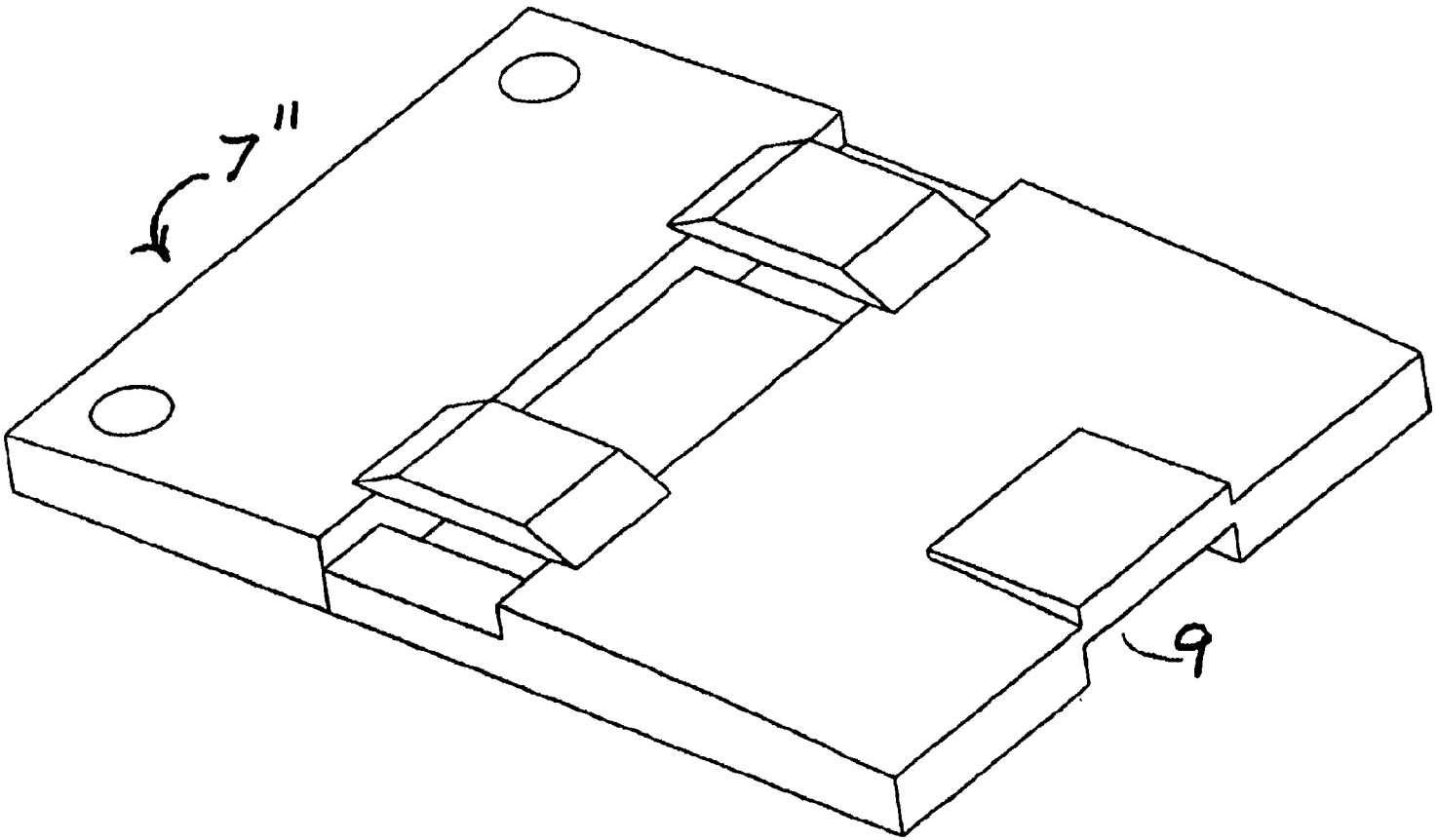
FIG. 4 is a perspective view of another embodiment of the support member of the invention.

Referring now to FIG. 4, another embodiment of the support member 7" is shown that may be effectively produced by a molding or die casting process.

Figure 5:
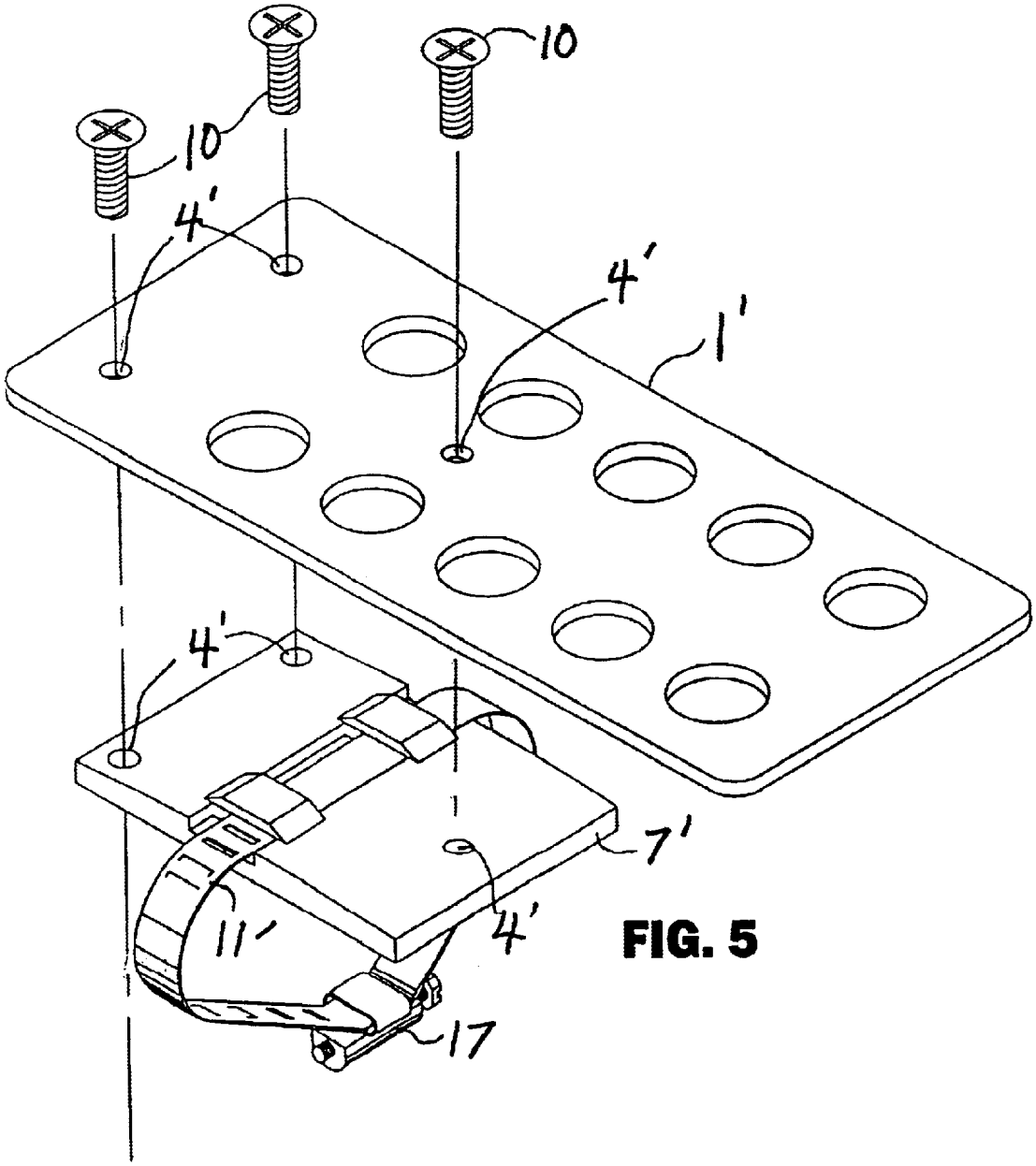
FIG. 5 is an exploded perspective view of another embodiment of the invention.

Referring now to FIG. 5, another embodiment of the invention is shown with a support member 7' that may be effectively produced by a molding or die casting process. It is provided with a strap clamp 11' that is drawn together by a worm mechanism 17 well known in the art of hose clamps. The member 7' and the rigid top plate 1' are each provided with three fastener receiving apertures 4' to securely join the two together by screw 10 without the need for a retaining hook.

Figure 6:
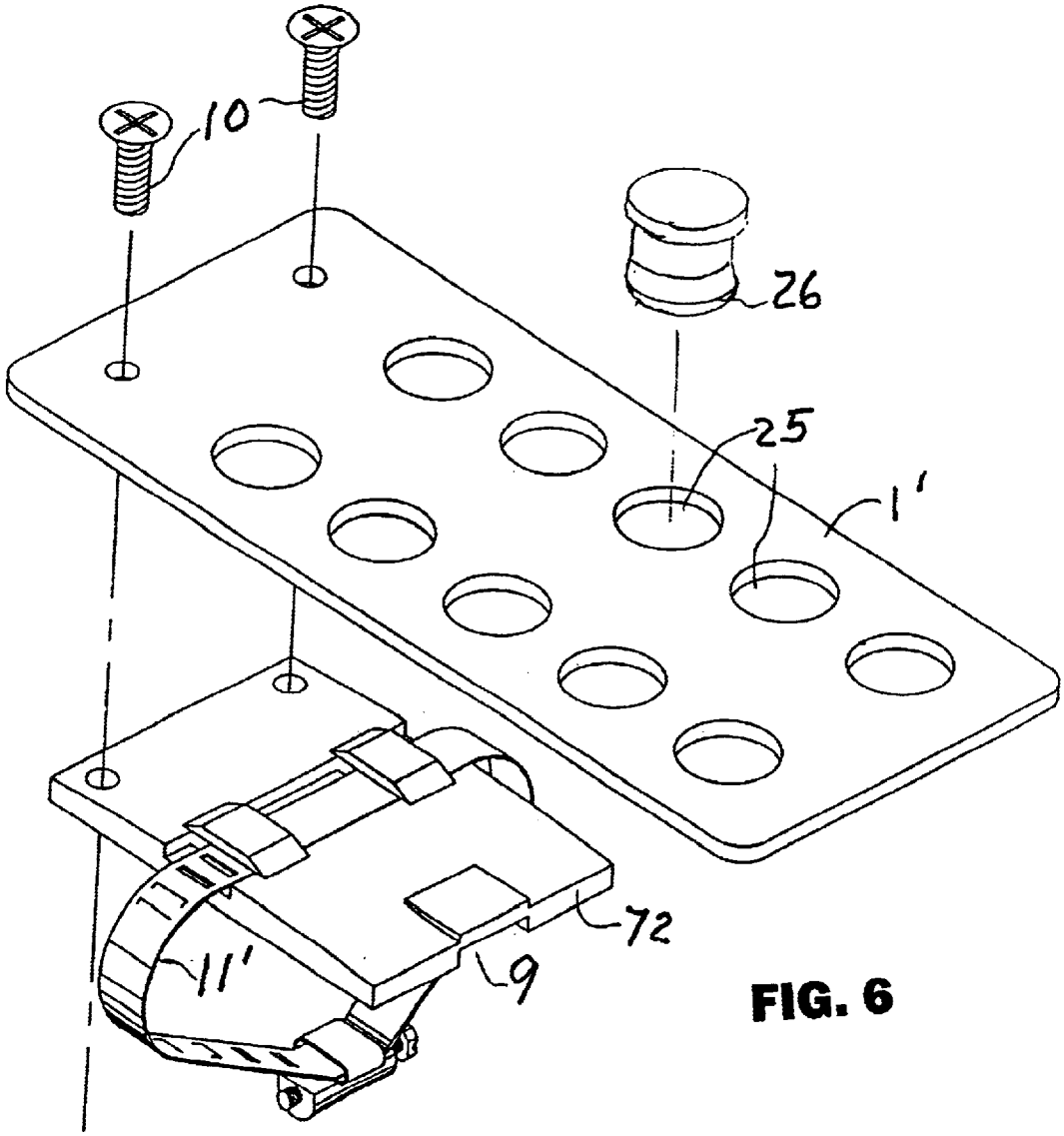
FIG. 6 is an exploded perspective view of another embodiment of the invention.

Referring now to FIG. 6, another embodiment of the invention is shown with a support member 72 that may be effectively produced by a molding or die casting process. It is provided with a strap clamp 11' that is drawn together by the worm mechanism 17. The top plate 1' is provided with apertures 25. Into each aperture 25, a rubber plug 26 is forced to provide the necessary skid resistance.

Figure 7:
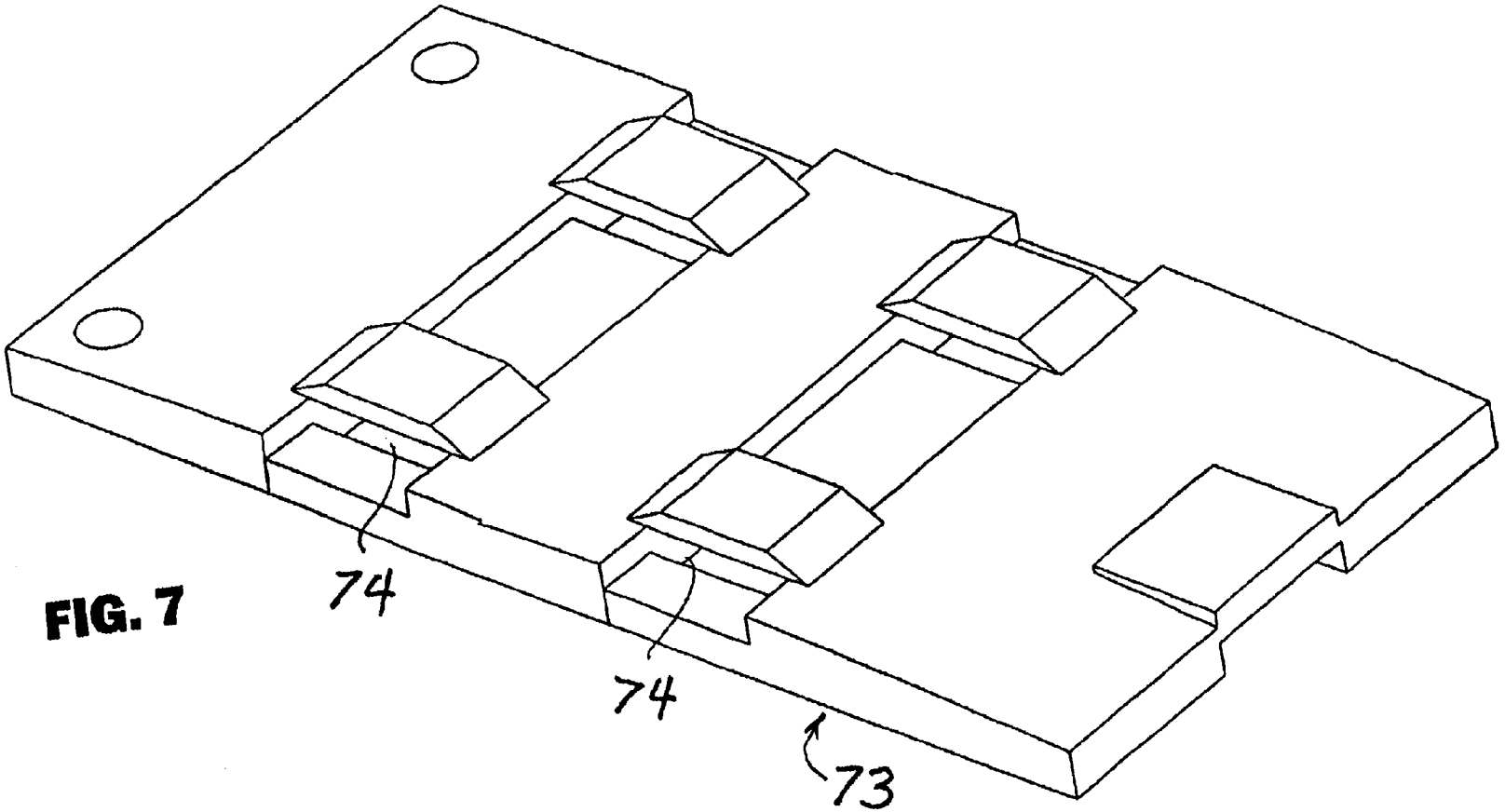
FIG. 7 is a perspective view of another embodiment of the support member of the invention.

Referring now to FIG. 7, another embodiment of the invention is shown with a support member 73 that is provided with molded means 74 for holding two strap clamps.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A skid resistant cover assembly for covering the foot pedal of a vehicle, the pedal having a top, sides, and a bottom, the cover assembly comprising:

a) a rigid plate having an upper surface provided with skid resistant properties and a plurality of through holes;

b) a support member having a plurality of apertures positioned for receiving fasteners passing through the through holes in the plate for securing the plate to the member;

c) a plurality of fasteners for passing through the plurality of through holes in the plate and into the apertures in the member for joining the plate and member together;

d) a flexible strap having an intermediate portion disposed over the top of the member with two ends passing from the intermediate portion down the sides of the member;

e) means on the member for holding the strap in position on the member; and f) means for drawing the two ends of the strap tightly together under the bottom of the pedal.

2. The assembly according to claim 1 in which the means for drawing the two ends of the strap tightly include a worm mechanism.

3. The assembly according to claim 1 in which the means for drawing the two ends of the strap tightly include a screw and threaded receptacle mechanism.

4. A skid resistant cover assembly for covering the foot pedal of a vehicle, the pedal having a top, sides, and a bottom, the cover assembly comprising:

a) a rigid plate having an upper surface provided with skid resistant properties and a plurality of through holes, and a lower surface with a retaining hook;

b) a support member having a plurality of apertures positioned for receiving fasteners passing through the through holes in the plate for securing the plate to the member, and a recess for receiving the retaining hook;

c) a plurality of fasteners for passing through the plurality of through holes in the plate and into the apertures in the member for joining the plate and member together;

d) a flexible strap clamp having an intermediate portion disposed over the top of the member with two ends passing from the intermediate portion down the sides of the member;

e) means on the member for holding the strap clamp in position on the member; and f) means below the member for drawing the strap clamp tightly together under the bottom of the pedal.

5. The assembly according to claim 4 in which the means for drawing the strap clamp tightly include a worm mechanism.

6. The assembly according to claim 4 in which the means for drawing the strap tightly include a screw and threaded receptacle mechanism.

7. A skid resistant cover assembly for covering the foot pedal of a vehicle, the pedal having a top, sides, and a bottom, the cover assembly comprising:

a) a rigid plate having an upper surface provided with skid resistant properties and a plurality of through holes;

b) a support member having a plurality of apertures positioned for receiving fasteners passing through the through holes in the plate for securing the plate to the member;

c) a plurality of fasteners for passing through the plurality of through holes in the plate and into the apertures in the member for joining the plate and member together;

d) at least one flexible strap having an intermediate portion disposed over the top of the member with two ends passing from the intermediate portion down the sides of the member;

e) means on the member for holding the at least one strap in position on the member; and f) means under the bottom of the pedal for drawing the at least one strap tightly together.

* * * * *